United States Patent [19]

Hemperly

[11] 4,431,313

[45] Feb. 14, 1984

[54] GAME TIMER

[76] Inventor: Richard E. Hemperly, 2544 Unicornio St., Carlsbad, Calif. 92008

[21] Appl. No.: 276,966

[22] Filed: Jun. 24, 1981

[51] Int. Cl.[3] ..... G04F 1/04; G04F 3/00; G04B 37/00

[52] U.S. Cl. ..... 368/93; 368/95; 368/96

[58] Field of Search ..... 368/93, 95, 96

[56] References Cited

U.S. PATENT DOCUMENTS

| | | | |
|---|---|---|---|
| 4,236,242 | 11/1980 | Barton | 368/95 |
| 4,238,846 | 12/1980 | Barton | 368/93 |
| 4,267,588 | 5/1981 | Daniels | 368/93 |
| 4,332,096 | 1/1982 | Kohner et al. | 368/93 X |
| 4,340,947 | 7/1982 | Barton | 368/93 |

FOREIGN PATENT DOCUMENTS

| | | | |
|---|---|---|---|
| 118498 | 4/1947 | Sweden | 368/96 |

*Primary Examiner*—J. V. Truhe
*Assistant Examiner*—Terry Flower
*Attorney, Agent, or Firm*—Brown & Martin

[57] ABSTRACT

A game timer for selectively timing the action time of two or more game players includes a timing unit for each player with the timing unit consisting of a reservoir containing a measured quantity of granular medium with a metered orifice for controlling the flow of the granular medium from the reservoir upon selected specific orientations for each separate reservoir. Each reservoir is oriented for a separate active and deactive orientation such that when one reservoir is actively timing, the other reservoir is inactive.

8 Claims, 3 Drawing Figures

GAME TIMER

BACKGROUND OF THE INVENTION

The present invention relates to timers and pertains particularly to a multi-unit game timer.

Many games such as Chess, Checkers, and the like, frequently include a special timing rule requiring each player to make their moves within a certain specified length of time. Typically each player would have a certain specified length of time to make all of his plays.

Some form of timer is normally employed which can be activated and deactivated by the players with each player deactivating his timing cycle or timer and activating the opponents timer upon completion of his move or play. Such timers are usually complicated and expensive.

It is therefore desirable that a simple and inexpensive multiple unit timer for games be available.

SUMMARY AND OBJECTS OF THE INVENTION

It is therefore the primary object of the present invention to provide an improved game timer.

In accordance with the primary aspect of the present invention, a game timer includes multiple timing units employing a flowing medium that is selectively activated and deactivated upon selective orientation of the timing unit with activation of one timing unit simultaneously deactivating the other timing unit.

BRIEF DESCRIPTION OF THE DRAWINGS

The above and other objects and advantages of the present invention will be apparent from the following description when read in conjunction with the drawings wherein.

DETAILED DESCRIPTION OF PREFERRED EMBODIMENTS

Figure 1:
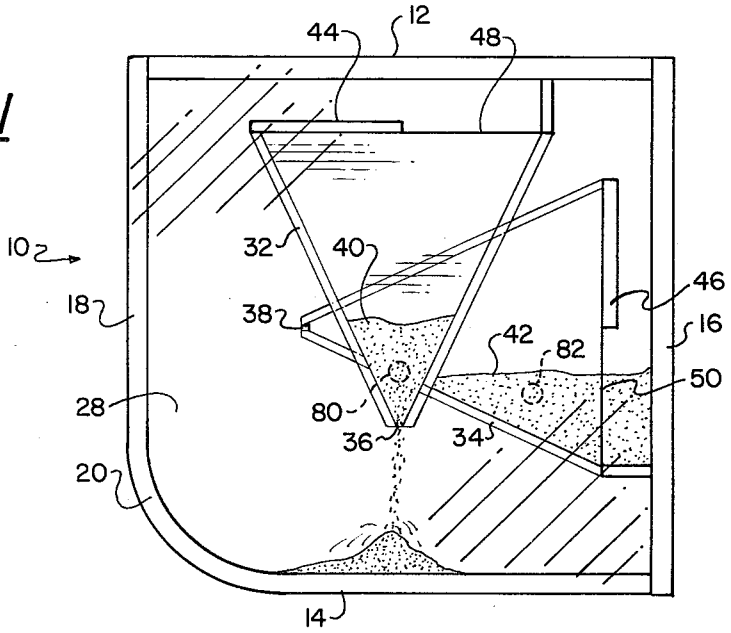
FIG. 1 is a side elevation view of a preferred embodiment of the invention.

Turning to the drawings, particularly FIG. 1, there is illustrated a timing device in accordance with the invention designated generally by the numeral 10 and comprising a generally box like container or housing of a substantially cubical configuration. The housing is defined by a plurality of generally flat parallel walls bounded together to define separate compartments or chambers. More particularly the housing comprises a first top 12 with a corresponding first bottom 14 with a second top 16 and a corresponding bottom 18. The alternate bottoms 14 and 18 joined at a rounded or curved corner 20 which functions to permit the housing to roll alternately back and forth between and alternately rest on the bottoms 14 and 18.

Figure 2:
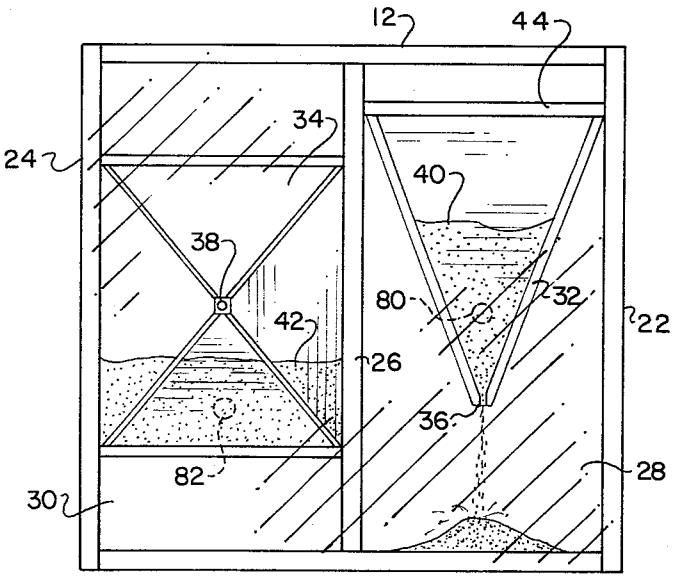
FIG. 2 is a front elevational view of the embodiment of FIG. 1.

Turning to FIG. 2, a pair of side panels 22 and 24 complete and enclose the housing with a partition 26 separating the interior of the housing into a pair of separate chambers 28 and 30.

The housing and other structure is preferably formed of a transparent material such as plexiglass or any other suitable plastic or even glass. The transparent nature of the structure provides advantages, as will be described but primarily that of enabling viewing of each timer from both sides of the housing for timing device.

Each chamber of the housing is provided with a container or reservoir, preferably having a generally pyramid configuration. These reservoirs, or containers 32 and 34 each respectively includes metered openings or ports 36 and 38. Each container also includes a measured quantity of a granular medium, such as sand, or the like. Preferably the media medium 40 and 42 are a specially prepared medium of microspheres that are specially prepared for use in hour glasses and the like. This provides a granular medium containing grains or granules that are substantially identical in size with a predictable rate of flow such that highly accurate flow rates can be established. Similarly, the metered openings are preferably of identical size cross section and configuration to provide equivalent and identical flow rate for the two separate timing units within the device. Although any number of timing units may be embodied within the timing device, only two are illustrated and will satisfy most applications.

In the illustrated embodiment, the granular medium 40 flows from the reservoir 32 in the illustrated orientation into the compartment 28 when the timing device is oriented such that it rests on the bottom 14. With this orientation, the timing unit defined by reservoir 32 is activated and the timing unit defined by reservoir 34 is deactivated. In other words, the orientation is such that the granular medium 40 will flow from the reservoir 32 whereas the medium 42 from in reservoir 34 will not flow therefrom.

Each of the respective reservoirs includes a top 44 and 46 respectively partially covering the top of each of the reservoirs forming passageway between the top thereof and the respective walls 12 and 16 to an opening 48 and 50 opening into the reservoir. This opening and passageway enable loading of the granular medium from the floor of the respective chambers 28 and 30 into the reservoirs. This is accomplished by rotation of the device as viewed in FIG. 1 in the counter-clock-wise direction as will be appreciated, the sand or granular medium will flow along the inside of walls 14, 18, 12 and 16 respectfully into a position to pass through openings 48 and 50 into their respective reservoir.

Once the sand or granular medium is in the position to be loaded into the respective reservoirs a timing cycle can be initiated. For example, with the rotation as indicated, the device may rest on surface of wall 16 such that the medium 42 would be within the area between walls 46 and 16 whereas the medium 40 would be partially within the reservoir 32 and partially in the opening 48. Upon rotation of the device to an orientation as shown in FIG. 1, to activate the first timing unit defined by reservoir 32, the sand or granular medium 40 will begin to flow from the reservoir by way of orifice 36. This will initiate a time sequence or time period for one player.

As soon as this player has made his move, he quickly rotates his unit from its first active position to a second active position resting on the wall 18 such that the unit defined by reservoir 32 is then deactivated while the unit defined by reservoir 34 is immediately activated. The time sequence or period for the second player is thus initiated. As soon as he has made his play or move, he rotates the unit back in a counter-clock-wise direction rolling or rocking it from its resting position on surface 18 to a resting position on surface 12 thereby deactivating the timing unit defined by reservoir 34 and activating timing unit defined by reservoir 32. This sequence alternates or continues until the game is over or the time for one of the players has expired. The duration of the timing intervals can be established by variations of the amount of the sand or granular medium or the orifice from the reservoir. The advantage of the illustrated construction is that the timing unit can be reloaded at any time without delay.

Figure 3:
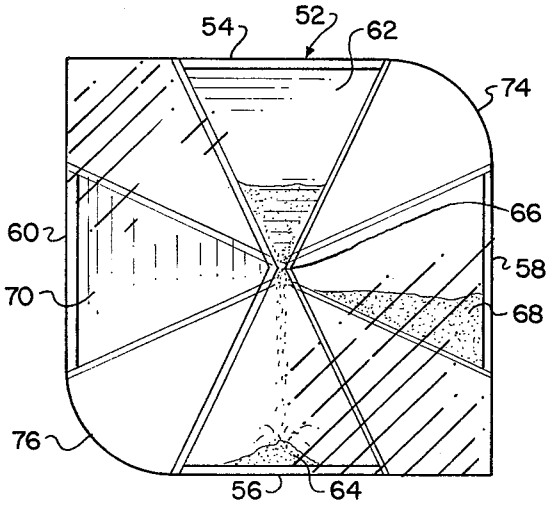
FIG. 3 is side elevational view of an alternate embodiment.

Turning now to FIG. 3, an alternate embodiment of the invention is illustrated wherein a housing of a generally cubical configuration 52 is provided with opposed flat sides 54, 56, 58 and 60. The housing is provided with opposed reservoirs 62 and 64 therein that are in communication by way of an metering orifice or passageway 66. These are in opposed relation and are somewhat typical hour glass type construction but may be formed in either a pyramid or conical configuration as preferred. Disposed at 90 degrees to this combination of reservoirs is a second combination of reservoirs 68 and 70 in communication by a metering orifice or passageway which is offset slightly to one side of the passageway or reservoir 66. Rounded corners 74 and 76 provide for alternate rotation of the device between surfaces 66 and 60 and 54 and 58. With this embodiment loading of adjacent reservoir separated by a rounded corner prepares the device for timing of two players with the sand or granular medium alternately flowing or selectively flowing to the opposite connected reservoir upon proper orientation of the device. Thus with the orientation, as illustrated, the granular medium or sand flows from reservoir 62 to reservoir 64. Rotation of the device to rest on surface 60 permits the sand or granular medium to flow from reservoir 68 into reservoir 70 thus, providing the alternate or activation of the alternate timing unit.

A flagging device of red or any other desirable color can be incorporated ino the timing units by means of a spherical ball such as the BB's fired from air rifles. It has been found that such spheres illustrated at 80 and 82 (FIGS. 1 and 2) placed within the granular medium will embed themselves within the granular medium and will not be visible under normal circumstances until substantially all of the sand or granular medium has flowed from the particular reservoir. The ball or sphere will drop to the bottom of the reservoir and will not impede the flow of the granular medium therefrom particularly in the pyramid shaped reservoirs. The ball or sphere becomes visible as soon as the last few grains of sand or the like, are about to flow from the reservoir.

While I have illustrated and described my invention by means of specific embodiments, it is to be understood that numerous changes and modifications may be made therein without departing from the spirit and scope of the invention as defined in the appended claims. For example, certain suitable liquids such as mercury, water, oil, certain gels and the like, can be used in place of a granular medium.

Having described my invention, I now claim:

1. A game timer apparatus comprising in combination:

a housing adapted to rest in a selected one of multiple positions;

a pair of separate timing units mounted within said housing;

each timing unit having an axis defining an active orientation at a right angle to the other corresponding to a separate one of said selected positions to activate its timing cycle, and each responsive to an orientation other than its active orientation to inactivate its timing cycle;

said timing units are defined by reservoirs having a pyramid configuration and a metered opening at the apex thereof for discharging a granular medium when said housing is oriented in a selected active orientation; and a predetermined quantity of granular medium in each of said reservoirs wherein said reservoirs are each disposed within a separate enclosed chamber in said housing and each are arranged to be reloaded with said granular medium upon rotation of said housing in one direction.

2. The game timer of claim 1 wherein said housing is of a generally cubical configuration with a rounded corner between two adjacent sides, and each of said adjacent sides define an active orientation for a separate one of said timing units when said housing is resting thereon and said rounded corner provide for rocking of said housing alternately between said sides for alternately activating said separate timing units.

3. A game timer apparatus comprising in combination:

a housing having a generally box-like configuration defined by a plurality of flat sides and adapted to rest in a selected one of multiple positions on selected ones of said sides;

a plurality of separate timing units each mounted within a separate chamber within said housing, each timing unit having an active orientation corresponding to a separate one of said selected positions to activate its timing cycle, and each responsive to an orientation other than its active orientation to inactivate its timing cycle;

said timing units are defined by reservoirs having a metered opening for discharging a flowable medium when said housing is oriented in a selected active orientation; and a predetermined quantity of flowable medium in each of said chambers and loadable into the respective reservoirs upon rotation of the housing in a selected direction.

4. The game timer of claim 3 wherein said reservoirs are two in number and the axes thereof are at right angles to one another.

5. The game timer of claim 4 wherein said reservoirs are pyramid in configuration and the metered opening is located at the apex thereof.

6. The game timer of claim 5 wherein said housing is of a generally cubical configuration with a rounded corner between two adjacent sides, and each of said adjacent sides defines an active orientation for a separate one of said timing units when said housing is resting thereon and said rounded corner provides for rocking of said housing alternately between said sides for alternately activating said separate timing units.

7. The game timer of claim 5 wherein said housing includes a rounded corner between surfaces defining a bottom thereof for said selected position.

8. The game timer of claim 3 wherein said timing units are defined by reservoirs having a metered opening for discharging a liquid when said housing is oriented in a selected active orientation; and a predetermined quantity of a liquid in each of said reservoirs.

* * * * *